United States Patent [19]

Bomgardner et al.

[11] 4,146,142

[45] Mar. 27, 1979

[54] FABRICATED BACKSTOP/BUFFSTOP

[75] Inventors: Charles T. Bomgardner; William S. Butler, both of Burleson; Harry B. Kalina, Arlington, all of Tex.

[73] Assignee: Halliburton Company, Duncan, Okla.

[21] Appl. No.: 834,092

[22] Filed: Sep. 19, 1977

[51] Int. Cl.[2] ..... B61G 9/04; B61G 9/02; B61G 9/06; B61G 11/00

[52] U.S. Cl. ..... 213/10; 213/8

[58] Field of Search ..... 213/7, 8, 9, 10, 11, 213/40 R, 40 S, 50, 58, 59, 220–223

[56] References Cited

U.S. PATENT DOCUMENTS

| | | | |
|---|---|---|---|
| 1,074,243 | 9/1913 | Campbell | 213/10 |
| 3,752,329 | 8/1973 | Seay | 213/8 |
| 3,854,596 | 12/1974 | Stephenson | 213/8 |

FOREIGN PATENT DOCUMENTS

| | | | |
|---|---|---|---|
| 1438193 | 4/1966 | France | 213/8 |

*Primary Examiner*—Trygve M. Blix
*Assistant Examiner*—D. W. Keen
*Attorney, Agent, or Firm*—John H. Tregoning; James R. Duzan

[57] ABSTRACT

A fabricated backstop/buffstop comprising a pair of parallel, juxtaposed side plates, each side plate having a central opening therein, a forward transverse member having each end thereof freely positioned in a portion of the central opening of each side plate of the pair of side plates and having a slot located in the center of the forward transverse member, and a rear transverse member having each end thereof freely positioned in a portion of the central opening of each side plate of the pair of side plates.

19 Claims, 8 Drawing Figures

FABRICATED BACKSTOP/BUFFSTOP

This invention relates generally to railway car structures and more particularly to a fabricated backstop/-buffstop for end-of-car hydraulic or oleopneumatic cushioning units capable of being installed and removed at the end of a railway car center sill.

Hydraulic or oleopneumatic cushioning units are normally installed in the ends of a railway car center sill structure with the socket end of the cushioning unit anchored to the center sill structure by means of a backstop. Depending upon the type of hydraulic or oleopneumatic cushioning unit, the backstop may also serve as a buffstop for the cushioning unit during full buff (hydraulic compression) of the cushioning unit to transfer the loads from the cushioning unit into the center sill structure. A typical combination backstop/buffstop not only must be designed to transfer loads to the center sill during the buff (hydraulic compression) mode of operation of the cushioning unit with a maximum buff loading being transferred to the center sill when the cushioning unit is abutting the backstop/buffstop, but must also be designed to transfer loads to the center sill during the draft (hydraulic extension) mode of operation of the cushioning unit.

A typical prior art backstop/buffstop has usually either been a casting or a welded fabrication. The cast type backstop/buffstop, while offering excellent load carrying and service characteristics, generally is more costly to manufacture than the welded fabricated type backstop/puffstop. However, even though cheaper, the welded fabricated type backstop/buffstop requires large amounts of weld areas, which are time consuming to make during manufacture, to carry the necessary design loads during the draft and buff modes of operation of the cushioning units.

In contrast to the prior art, the present invention comprises a fabricated backstop/buffstop which requires no welding of the transverse load carrying members to the side plates of the fabricated backstop/buffstop to retain the transverse load carrying members wholly therein without protruding through or into the center sill wall of the railway car, although the ends of the transverse load carrying members may contact the center sill, and which is capable of carrying the required design draft and buff loads of the cushioning units while transferring these loads to the center sill of the railway car.

Figure 1:
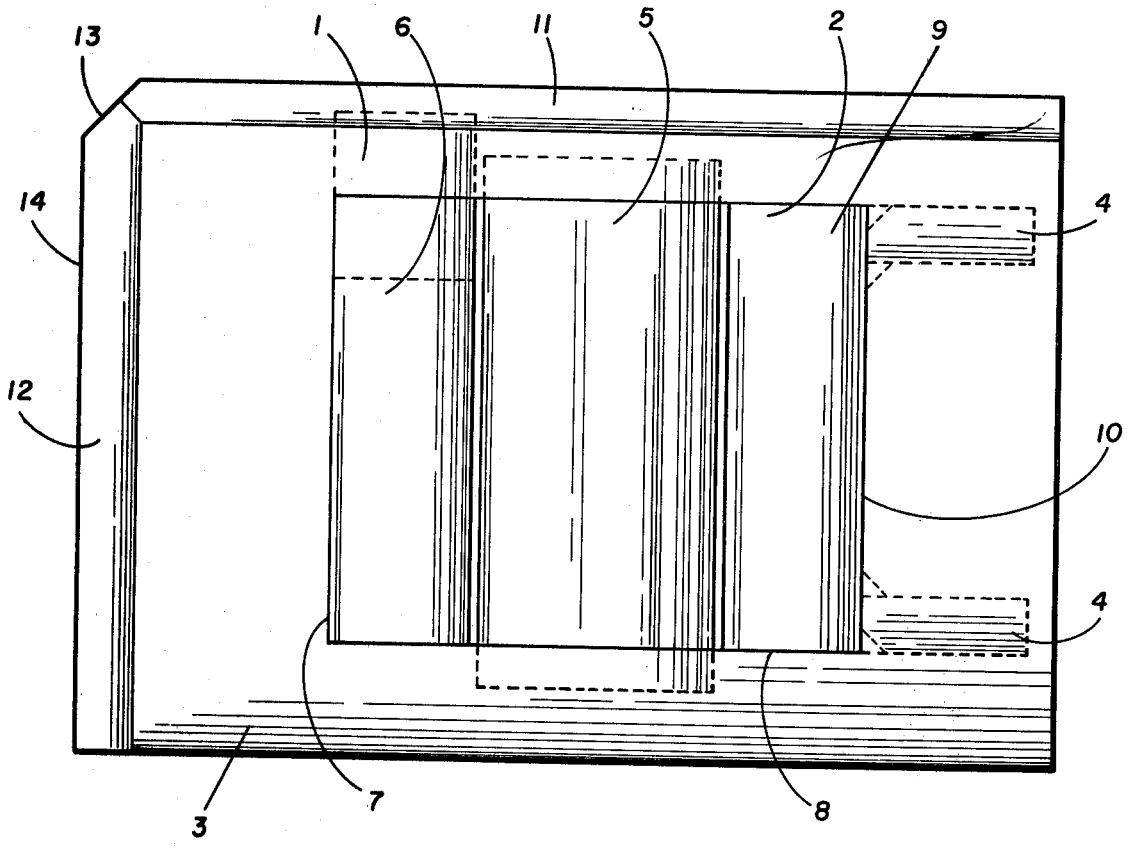
FIG. 1 is the preferred embodiment of the invention shown in a side elevational view.

Referring to FIG. 1, the present invention is shown in its preferred embodiment.

The fabricated backstop/buffstop comprises forward transverse member 1, rear transverse member 2, side plates 3 and spacer plates 5.

The forward transverse member 1 is shown having an end 6 abutting and freely positioned for relative movement with respect to the forward wall 7 of the opening 8 in side plate 3. Although the forward transverse member 1 can be formed from steel plate, it could be either a forging or a casting if so desired.

As shown, the rear transverse member 2 has an end 9 abutting and freely positioned for relative movement with respect to the rear wall 10 of the opening 8 in the side plate 3. Since the rear transverse member 2 serves as the backstop for the socket end of the cushioning unit rod during the buff mode of operation of the cushioning unit, the rear transverse member 2 has transverse reinforcing ribs 4 (shown in phantom) welded to the backside of the rear transverse member 2 at the upper and lower edges thereof to increase the sectional strength properties of the transverse member 2. Although two reinforcing ribs have been shown, any number may be employed. For instance, if the transverse member is sufficiently thick, no ribs may be required while three or more ribs may be required as the rear transverse member is made thinner. Even though the rear transverse member 2 has been shown with the reinforcing ribs welded thereto when made from steel plate, the transverse member may be either a forging or a casting with any desired number of reinforcing ribs integrally formed thereon.

The side plate 3 is formed with a central opening 8 into which the ends of the forward transverse member 1 and rear transverse member 2 extend abutting forward wall 7 and rearward wall 10 of the opening 8, respectively. The top exterior edge 11, the front exterior edge 12 and the point of the intersection 13 of the top exterior edge 11 and front exterior edge 12 are beveled to facilitate assembly and welding of the fabricated backstop/-buffstop in the center sill of the railway car. When installed in the center sill of the railway car, the front edge 14 of each side plate 3 serves as the buffstop for the installed cushioning unit.

Each spacer plate 5 is secured to its respective side plate 3 on the interior surface thereof in the center of the hole 8 to prevent rotation of the socket end having radius plates thereon of a cushioning unit rod of a cushioning unit installed in the center sill of a railway car and to position or space the forward transverse member 1 with respect to the rear transverse member 2. The spacer plate 5 may be secured to the side plate 3 by any suitable means such as welding.

Figure 2:
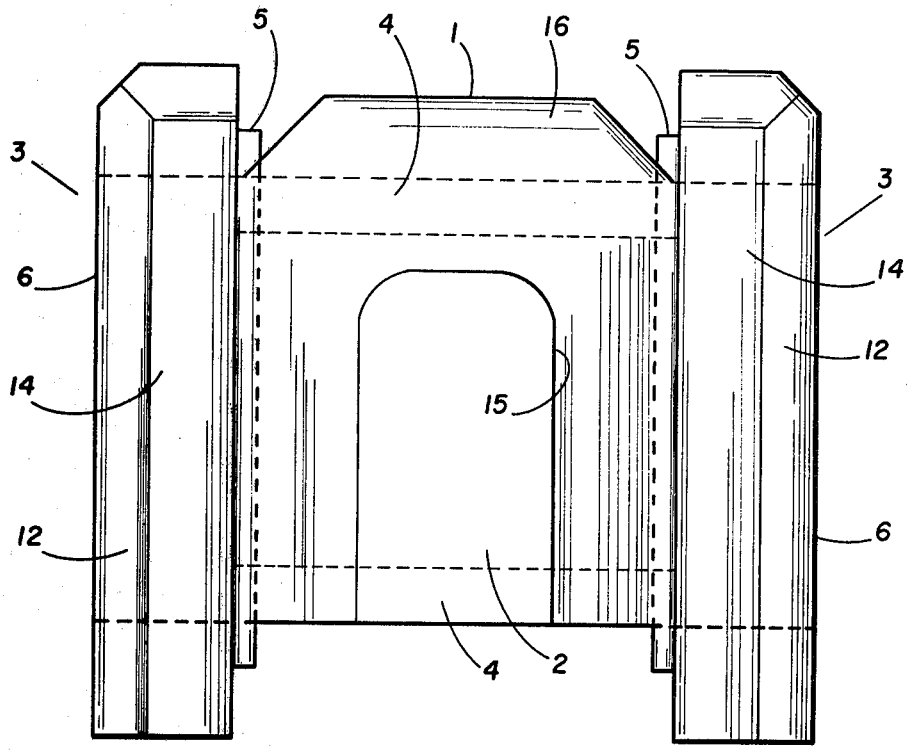
FIG. 2 is the preferred embodiment of the invention shown in a front elevational view.

Referring to FIG. 2, the fabricated backstop/buffstop is shown with the front transverse member 1 having a slot 15 intermediate ends 6 of the transverse member through which the cushioning unit rod passes. Since the slot 15 in the forward transverse member 1 must be sufficiently large to provide adequate clearance for the cushioning unit rod, the forward transverse member 1 is formed with an upstanding portion 16 to provide adequate sectional strength properties for carrying the loads transferred to the forward transverse member 1 by the socket end of the cushioning unit rod during the draft mode of operation of the cushioning unit. Although the forward transverse member 1 has been shown with an upstanding portion 16, the forward transverse member 1 could instead be formed with a reinforcing rib located on the front surface thereof to increase sectional strength properties. As shown, the forward transverse member 1 is formed having its ends 6 extending into, but not through, the opening 8 in each side plate 3.

Figure 3:
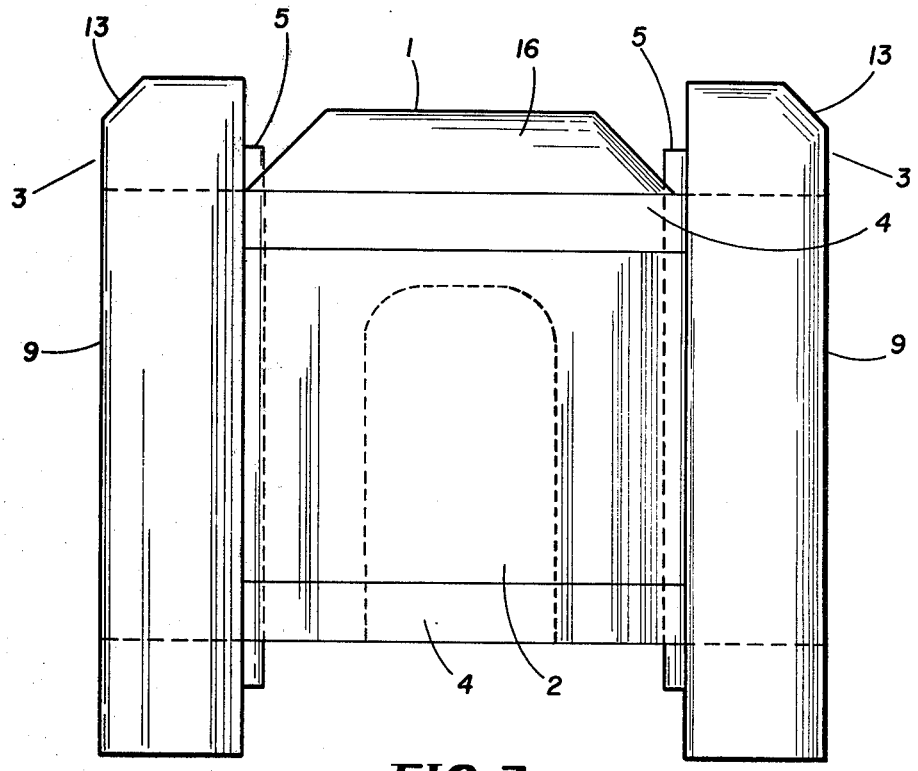
FIG. 3 is the preferred embodiment of the invention shown in a rear elevational view.

Referring to FIG. 3, the fabricated backstop/buffstop is shown with the rear transverse member 2 having two reinforcing ribs 4 thereon and having ends 9 projecting into side plates 3, but not therethrough.

Figure 4:
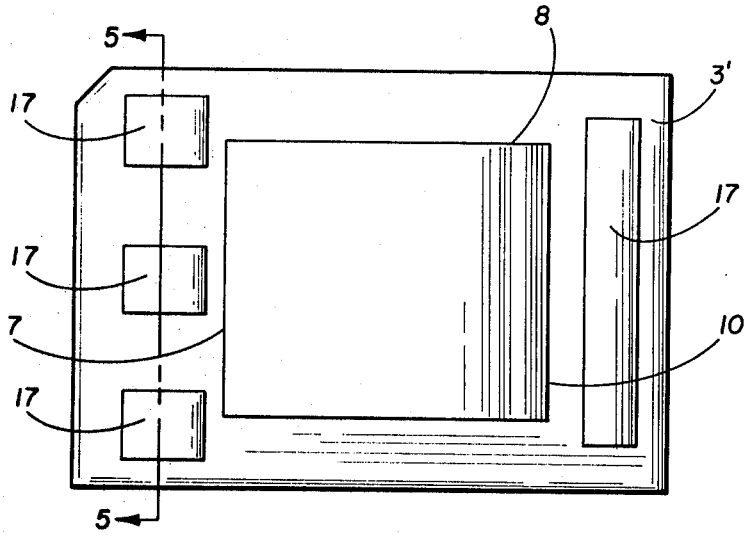
FIG. 4 is a modified embodiment of the side plates of the present invention in a side elevational view.

Referring to FIG. 4, a modified embodiment of the interior side of a side plate 3' is shown. The side plate 3' is a forged side plate having a central opening 8 therein and a plurality of recesses 17 therein. The forged side plate 3' can be formed with recesses 17 to reduce the weight of the side plate and material cost while maintaining the same sectional strength properties as that of a side plate formed from rolled steel plate.

Figure 5:
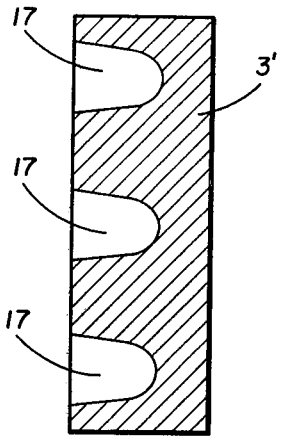
FIG. 5 is a cross-sectional view taken along lines 5—5 of FIG. 4.

As shown in FIG. 5, the side plate 3' has a plurality of recesses 17 formed during the forging operation extending through a portion of the thickness of the plate from the interior side of the side plate 3' towards the exterior side.

Figure 6:
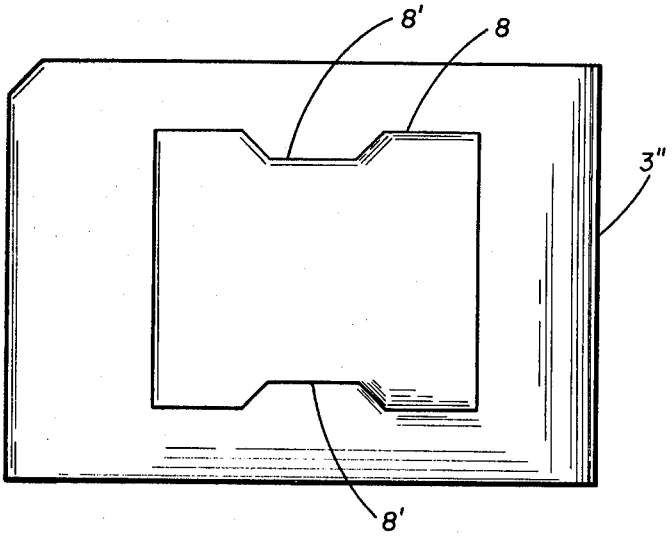
FIG. 6 is a modified embodiment of the side plates of the present invention shown in a side elevational view.

In FIG. 6, a modified embodiment side plate 3'' is shown having central opening 8 formed with lugs 8' protruding into the opening 8 to form the central opening 8 having a reduced area portion. The lugs 8' serve as a means to position or space the forward transverse member 1 from the rear transverse member 2 without requiring the spacer plates 5 to do so when the fabricated backstop/buffstop is installed in the center sill of a railway car.

Figure 7:
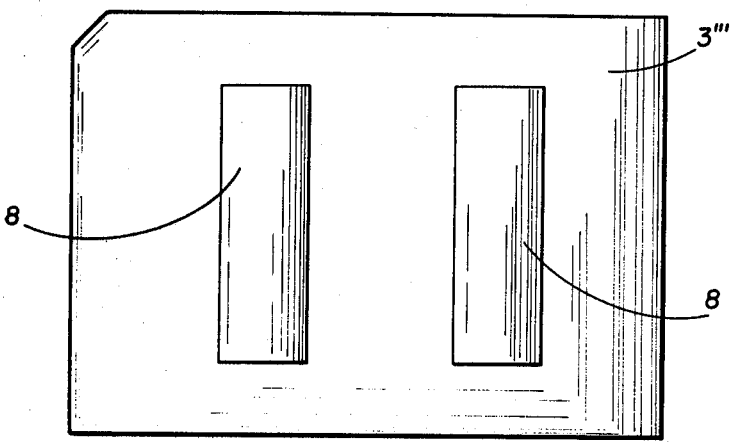
FIG. 7 is a modified embodiment of the side plates of the present invention shown in a side elevational view.

As shown in FIG. 7, a modified embodiment side plate 3''' is formed with two openings 8, one each for the forward transverse member 1 and the rear transverse member 2. By having an opening 8 for each transverse member the forward transverse member 1 is isolated from contact by and positively spaced from the rear transverse member 2 with the spacer plates 5 not being required.

Figure 8:
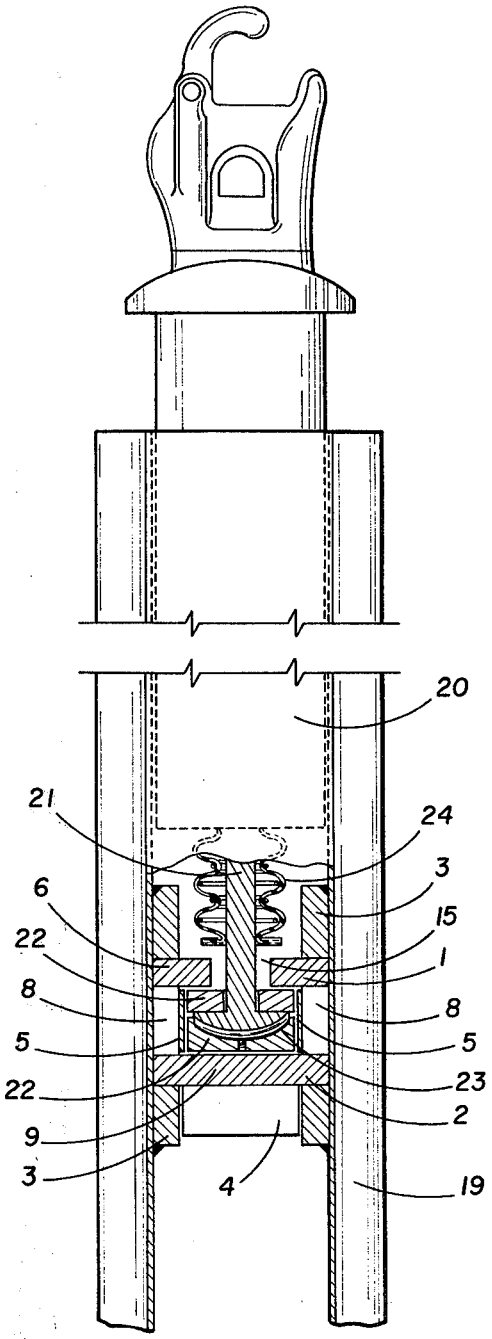
FIG. 8 is a cross-sectional view of the invention installed in the center sill of a railway car.

Referring to FIG. 8, the fabricated backstop/buffstop is shown installed in the center sill of a railway car. A hydraulic or oleopneumatic cushioning unit 20 is installed in the center sill 19 of a railway car having the rod 21 of the cushioning unit 20 projecting through slot 15 in the front transverse member 1 of the fabricated backstop/buffstop with the socket end 23 of the rod 21 having radius plates 22 thereon being positioned between the forward transverse member 1 and the rear transverse member 2 of the fabricated backstop/buffstop. A reinforced elastomeric boot 24 may be installed about the rod 21 to serve as a dust cover for the rod 21, if so desired.

When the fabricated backstop/buffstop is installed in the center sill 19 of a railway car, it is held in position in the center sill 19 by welding about the peripheral edges of the side plates 3 while the forward transverse member 1 and the rear transverse member 2 are retained with their ends 6 and 9 respectively, being freely positioned in the openings 8 of the side plates 3 possibly contacting the center sill 19 of the railway car but not extending into or therethrough. As shown, the spacer plates 5 are installed on the interior surfaces of the side plates 3 covering a portion of the opening 8 in each side plate 3 to prevent the rotation of the socket end 23 of the rod 21 having radius plates 22 thereon, as well as to position or space the forward transverse member 1 from the rear transverse member 2.

While the fabricated backstop/buffstop has been shown in FIG. 8 with a cushioning unit having the socket end of the cushioning unit rod having radius plates thereon installed in the backstop/buffstop, the backstop/buffstop can be used with any type cushioning unit, such as a unit having no radius plates on the socket end of the cushioning unit rod or a unit which has the housing end secured in the backstop/buffstop rather than the socket end of the cushioning unit.

While the invention has been described with reference to preferred and alternative embodiments, it will be appreciated by those skilled in the art that additions, deletions, modifications and substitutions, or other changes not specifically described may be made which fall within the purview of the appended claims.

What is claimed as new and desired to be secured by Letters Patent is:

1. A fabricated backstop/buffstop adapted for use in the center sill of a railcar having side wall surfaces therein, said fabricated backstop/buffstop comprising:

a pair of parallel, juxtaposed side plates, each side plate having a central opening therein;

a forward transverse member having each end thereof freely positioned in a portion of the central opening of each side plate of said pair of side plates, and having a slot located in the center of said forward transverse member; and a rear transverse member having each end thereof freely positioned in a portion of the central opening of each side plate of said pair of side plates whereby said pair of side plates are secured to the side wall surfaces of said center sill, each side plate of said pair of side plates being in juxtaposed relation to the other side plate of said pair of side plates with said forward transverse member and said rear transverse member being installed therebetween and having relative movement with respect thereto.

2. The fabricated backstop/buffstop of claim 1 further comprising:

spacer means secured to each side plate of said pair of side plates covering a portion of the central opening therein thereby spacing said forward transverse member from said rear transverse member.

3. The fabricated backstop/buffstop of claim 1 wherein said rear transverse member further having reinforcing means on the rear surface thereof.

4. The fabricated backstop/buffstop of claim 1 wherein the central opening in each side plate of said pair of side plates contains a reduced area portion in the center thereof formed by lugs on the side plate extending into the central opening.

5. A fabricated backstop/buffstop adapted for use in the center sill of a railcar having side wall surfaces therein, said fabricated backstop/buffstop comprising:

a pair of parallel, juxtaposed side plates, each side plate having a central opening therein;

a forward transverse member having each end thereof freely positioned in a portion of the central opening of each side plate of said pair of side plates, and having a slot located in the center of said forward transverse member;

a rear transverse member having each end thereof freely positioned in a portion of the central opening of each side plate of said pair of side plates; and spacer means secured to each side plate of said pair of side plates covering a portion of the central opening therein thereby spacing said forward transverse member from said rear transverse member whereby said pair of side plates are secured to the side wall surfaces of said center sill, each side plate of said pair of side plates being in juxtaposed relation to the other side plate of said pair of side plates with said forward transverse member and said rear transverse member being installed therebetween and having relative movement with respect thereto.

6. The fabricated backstop/buffstop of claim 5 wherein said rear transverse member further having reinforcing means on the rear surface thereof.

7. A fabricated backstop/buffstop adapted for use in the center sill of a railcar having side wall surfaces therein, said fabricated backstop/buffstop comprising:

a pair of parallel, juxtaposed side plates, each side plate having a pair of openings therein;

a forward transverse member having each end thereof freely positioned in the forward opening of each side plate of said pair of side plates, and having a slot located in the center of said forward transverse member; and a rear transverse member having each end thereof freely positioned in the rear opening of said side plate of said pair of side plates whereby said pair of side plates are secured to the side wall surfaces of said center sill, each side plate of said pair of side plates being in juxtaposed relation to the other side plate of said pair of side plates with said forward transverse member and said rear transverse member being installed therebetween and having relative movement with respect thereto.

8. The fabricated backstop/buffstop of claim 7 wherein said rear transverse member further comprises reinforcement means on the rear surface thereof.

9. In combination, a center sill of a railway car having side wall surfaces therein and a fabricated backstop/-buffstop installed therein comprising:

a pair of parallel side plates, each side plate being secured to a side wall surface of said center sill in juxtaposed relationship to the other side plate of said pair of parallel side plates and having a central opening therein;

a forward transverse member having each end thereof freely positioned in a portion of the central opening of each side plate of said pair of side plates while neither protruding into nor through the side wall surfaces of said center sill, and having a slot located in the center of said forward transverse member; and a rear transverse member having each end thereof freely positioned in a portion of the central opening of each side plate of said pair of side plates while neither protruding into nor through the side wall surfaces of said center sill.

10. The combination of claim 9 further comprising:

spacer means secured to each side plate of said pair of side plates covering a portion of the central opening therein thereby spacing said forward transverse member from said rear transverse member.

11. The combination of claim 9 further comprising:

spacer means secured to each side plate of said pair of side plates covering a portion of the central opening between said forward transverse member and said rear transverse member.

12. The combination of claim 9 wherein said rear transverse member further having reinforcing means on the rear surface thereof.

13. The combination of claim 9 wherein the central opening in each side plate of said pair of side plates contains a reduced area portion in the center thereof.

14. In combination, a center sill of a railway car having side wall surfaces therein and a fabricated backstop/buffstop installed therein comprising:

a pair of parallel side plates, each side plate being secured to a side wall surface of said center sill in juxtaposed relationship to the other side plate of said pair of parallel side plates and having a central opening therein;

a forward transverse member having each end thereof freely positioned in a portion of the central opening of each side plate of said pair of side plates while neither protruding into nor through the side wall surfaces of said center sill, and having a slot located in the center of said forward transverse member;

a rear transverse member having each end thereof freely positioned in a portion of the central opening of each side plate of said pair of side plates while neither protruding into nor through the side wall surfaces of said center sill; and spacer means secured to each side plate of said pair of side plates covering a portion of the central opening therein thereby spacing said forward transverse member from said rear transverse member.

15. The combination of claim 14 wherein said rear transverse member further having reinforcing means on the rear surface thereof.

16. In combination, a center sill of a railway car having side wall surfaces therein and a fabricated backstop/buffstop comprising:

a pair of parallel side plates, each side plate secured to a side wall surface of said center sill in juxtaposed relationship to the other side plate of said pair of parallel side plates and having a central opening therein;

a forward transverse member having each end thereof freely positioned in a portion of the central opening of each side plate of said pair of side plates while neither protruding into nor through the side wall surfaces of said center sill, and having a slot located in the center of said forward transverse member;

a rear transverse member having each end thereof freely positioned in a portion of the central opening of each side plate of said pair of side plates while neither protruding into nor through the side wall surfaces of said center sill, and having reinforcing means on the rear surface thereof; and spacer means secured to each side plate of said pair of side plates covering a portion of the central opening therein thereby spacing said forward transverse member from said rear transverse member.

17. In combination, a center sill of a railway car having side wall surfaces therein and a fabricated backstop/buffstop comprising:

a pair of parallel side plates, each side plate secured to a side wall surface of said center sill in juxtaposed relationship to the other side plate of said pair of parallel side plates and having a pair of openings therein;

a forward transverse member having each end thereof freely positioned in the forward opening of each side plate of said pair of side plates while neither protruding into nor through the side wall surfaces of said center sill, and having a slot located in the center of said forward transverse member; and a rear transverse member having each end thereof freely positioned in the rear opening of each side plate of said pair of side plates while neither protruding into nor through the side wall surfaces of said center sill.

18. The combination of claim 17 wherein said rear transverse member further comprising reinforcement means on the rear surface thereof.

19. A fabricated backstop/buffstop adapted for use in the center sill of a railcar having side wall surfaces therein, said fabricated backstop/buffstop comprising:

a pair of parallel, juxtaposed side plates, each side plate having a central opening therein;

a forward transverse member having each end thereof freely positioned in a portion of the central opening of each side plate of said pair of side plates, and having a slot located in the center of said forward transverse member;

a rear transverse member having each end thereof freely positioned in a portion of the central opening of each side plate of said pair of side plates, and having reinforcing means on the rear surface thereof; and spacer means secured to each side plate of said pair of side plates covering a portion of the central opening therein thereby spacing said forward transverse member from said rear transverse member whereby said pair of side plates are secured to the side wall surfaces of said center sill, each side plate of said pair of side plates being in juxtaposed relation to the other side plate of said pair of side plates with said forward transverse member and said rear transverse member being installed therebetween and having relative movement with respect thereto.

* * * * *